US005531355A

United States Patent [19]

Ullmann et al.

[11] Patent Number: 5,531,355

[45] Date of Patent: Jul. 2, 1996

[54] SINGLE VEND MACHINE

[76] Inventors: Ralph J. Ullmann, Rte. 2, Box 193, Shiner, Tex. 77995; Harvey G. Kresta, P.O. Box 667, Shiner, Tex. 77984

[21] Appl. No.: 303,053

[22] Filed: Sep. 8, 1994

[51] Int. Cl.[6] ..... B65H 3/00

[52] U.S. Cl. ..... 221/191; 221/229; 221/247

[58] Field of Search ..... 221/191, 249, 221/229, 192, 247, 210, 213, 195, 196, 277, 268, 274, 227, 231

[56] References Cited

U.S. PATENT DOCUMENTS 4,558,803 12/1985 Draper et al. ..... 221/249

4,700,869 10/1987 Bogner ..... 221/249

*Primary Examiner*—Kenneth Noland

[57] ABSTRACT

A machine for vending stacked articles, such as newspapers, one at a time. The machine includes a paper feed mechanism, operated through the opening of the door, which disengages when the door is about halfway open. The device also includes a mechanism which automatically adjusts to the thickness of the paper to be vended, which includes an elevated shelf, spring loaded to bring a paper to a position adjacent a slot through which the paper feed mechanism urges the paper. The slot is covered by a one-way flap, allowing the paper to issue outward but prevents a dishonest customer from reaching through the slot to take additional papers.

13 Claims, 7 Drawing Sheets

SINGLE VEND MACHINE

FIELD OF THE INVENTION

A machine for vending stacked articles one by one, more specifically, a single vend machine in which a feed mechanism actuated through levers by opening up a door of the machine feeds the newspaper through a slotted insert in the front opening of the cabinet of the newspaper vending machine.

BACKGROUND OF THE INVENTION

Sometimes dishonest customers pilfer papers from newspaper vending machines by inserting a coin, opening up the door and removing several editions of the paper. That is, most newspaper vending machines are based on a modified form of the honor system. When a coin is inserted, the denomination is typically sufficient for a single edition of the paper. However, with the door open, a dishonest consumer may remove several editions. This is often done when a special edition contains coupons, for example.

Numerous devices have been provided that will fit standard-sized newspaper cabinets to provide them with the capability of vending newspapers one at a time, and denying the access to the stack by the consumer.

However, none of the previous single vend devices have the capabilities of applicants' present invention.

Some prior art single vend machines operated a feed mechanism through a series of levers. In these prior art devices, the door, typically hinged to the front opening of the cabinet, would operate levers to feed a newspaper to a consumer. However, these prior art devices would sometimes jam when either the consumer opened the door too fast or too hard, or attempted to open the door part way and then jam it shut before opening it up fully.

Applicant provides, in their unique single vend apparatus, retrofittable to a standard-sized, rectangular newspaper vending machine cabinet without substantial modification, a lever mechanism operating a paper feed mechanism. The lever mechanism is attached to the door such that the door in its first 30°–45° (approximately) of travel will actuate the feed mechanism and urge the topmost newspaper of the stack through an insert slot, but the feed mechanism will, thereafter, be disengaged and the door free to move through the remainder of its arc (typically 45°–60°) with the feed mechanism disengaged. Moreover, applicants' feed mechanism includes a device which will prevent the door, once it commences its opening swing, to be reversed before it passes the intermediate point (point of latch mechanism disengagement). Further, as the door is being closed and passes the intermediate point on its way to a closed position, it can not be reopened.

Newspaper dispensing machines of the elevated shelf variety (shelf moves up as topmost paper is dispensed) typically need to be preadjusted for the thickness of the newspaper to be vended. Here, applicants provide an automatic paper thickness adjusting device consisting of a pair of threaded rods (one fixed, one moveable) and a ratchet mechanism consisting of a pair of spring loaded dogs operating on the rods through a handle. The function of this ratchet mechanism is to maintain the position of the topmost paper adjacent a slot through which the newspaper will be vended or dispensed as the door is opened. The slot is of a limited thickness so it is difficult for the dishonest consumer to get his fingers through it and pull out additional papers. Moreover, the slot has a flap which makes reaching through it difficult. In any case, applicants' unique elevated shelf has a rachet mechanism that automatically adjusts for the thickness of the paper. That is, the vendor, when stacking either thick or thin papers into the vending machine, does not have to preadjust for the thickness of the papers.

SUMMARY OF THE INVENTION

Thus, applicant provides a unique, retrofittable single vend device for a door-operated newspaper vending machine which has a paper feed mechanism that is jamproof, or at least jam resistant, and an elevated shelf with an automatic paper thickness adjusting device incorporated therein.

This and other objects are provided for in an apparatus for dispensing and vending newspapers one at a time. More specifically, an apparatus for dispensing and vending newspapers, one at a time, from a stack of newspapers, the apparatus comprising: a cabinet, said cabinet having walls defining a front opening; a shelf for holding a plurality of stacked newspapers within said cabinet; spring bias means to bias said shelf upward; a hinged door pivotable between a closed position and an open position, said door mounted in the front opening of said cabinet; an insert having a slot, the slot dimensioned for receipt of a paper therethrough, the insert dimensioned to fit within the front wall opening of said cabinet without interfering with the opening and closing of said hinged door; feed means for engaging stacked newspapers and feeding a single newspaper from a stack of multiple newspapers through the slot of said insert, from a stack position to a vend position; and lever means operatively engaging said door and said feed means wherein said door moving between a closed position and an open position moves said feed means to vend one of the stacked newspapers through the slot of said insert.

DETAILED DESCRIPTION OF THE PREFERRED EMBODIMENT

Figure 1:
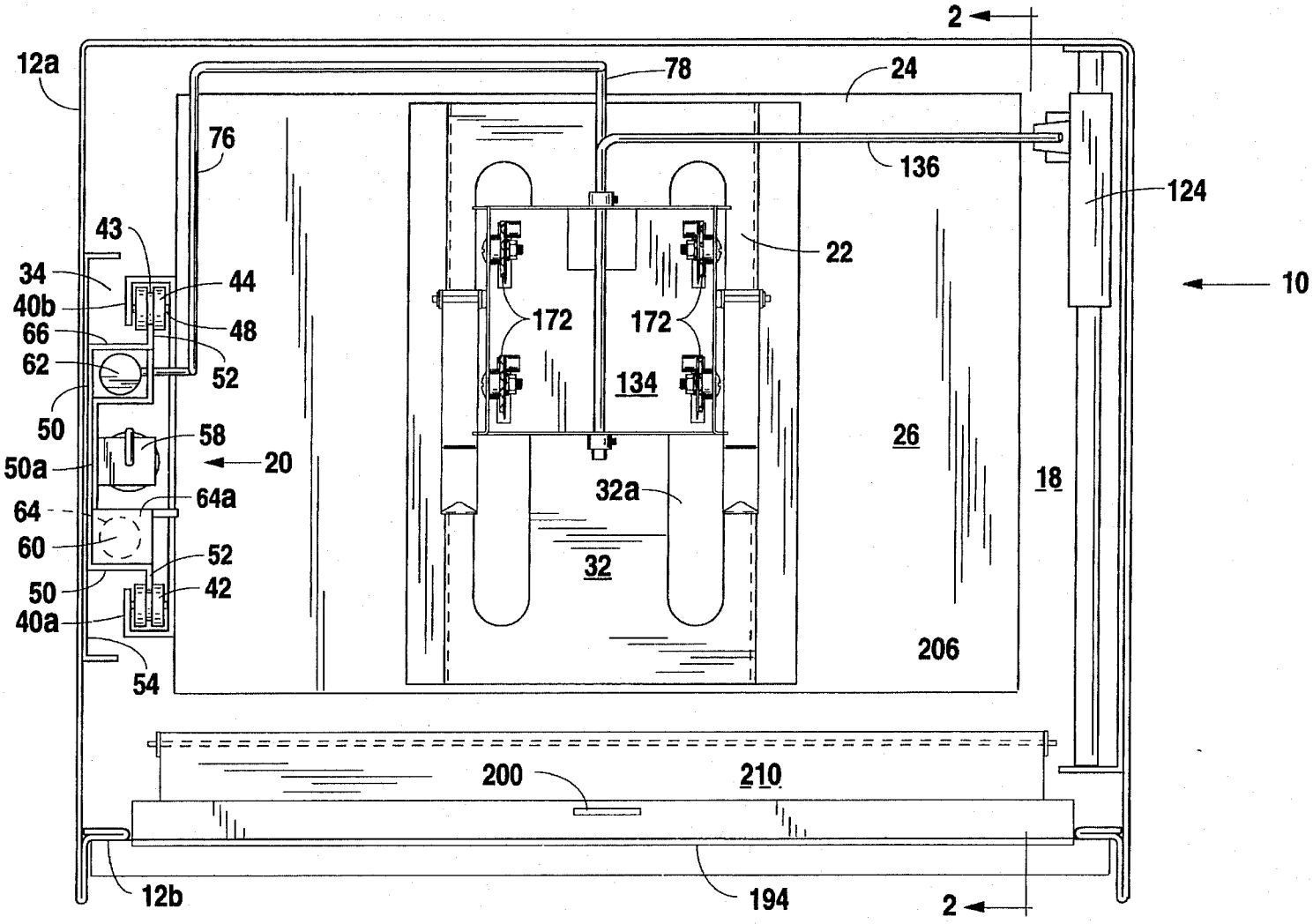
FIG. 1 is a to elevational view of applicants' invention viewed with the top wall of the newspaper cabinet removed.
Figure 2:
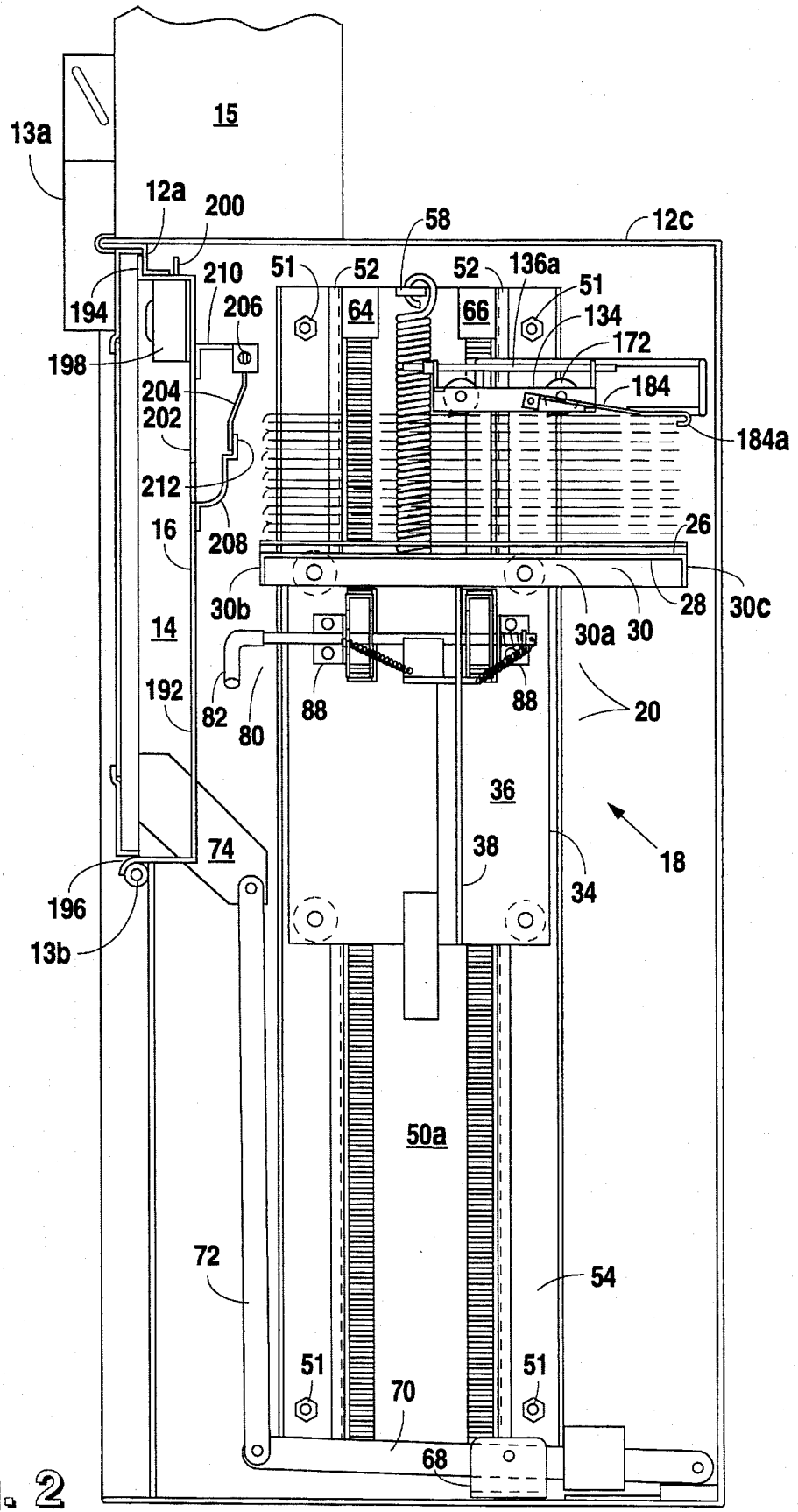
FIG. 2 is a side elevational cut-away view of applicants' invention showing newspapers stacked, the door of the cabinet closed, the feed carriage in a retracted position and ready for the next vend.
Figure 3:
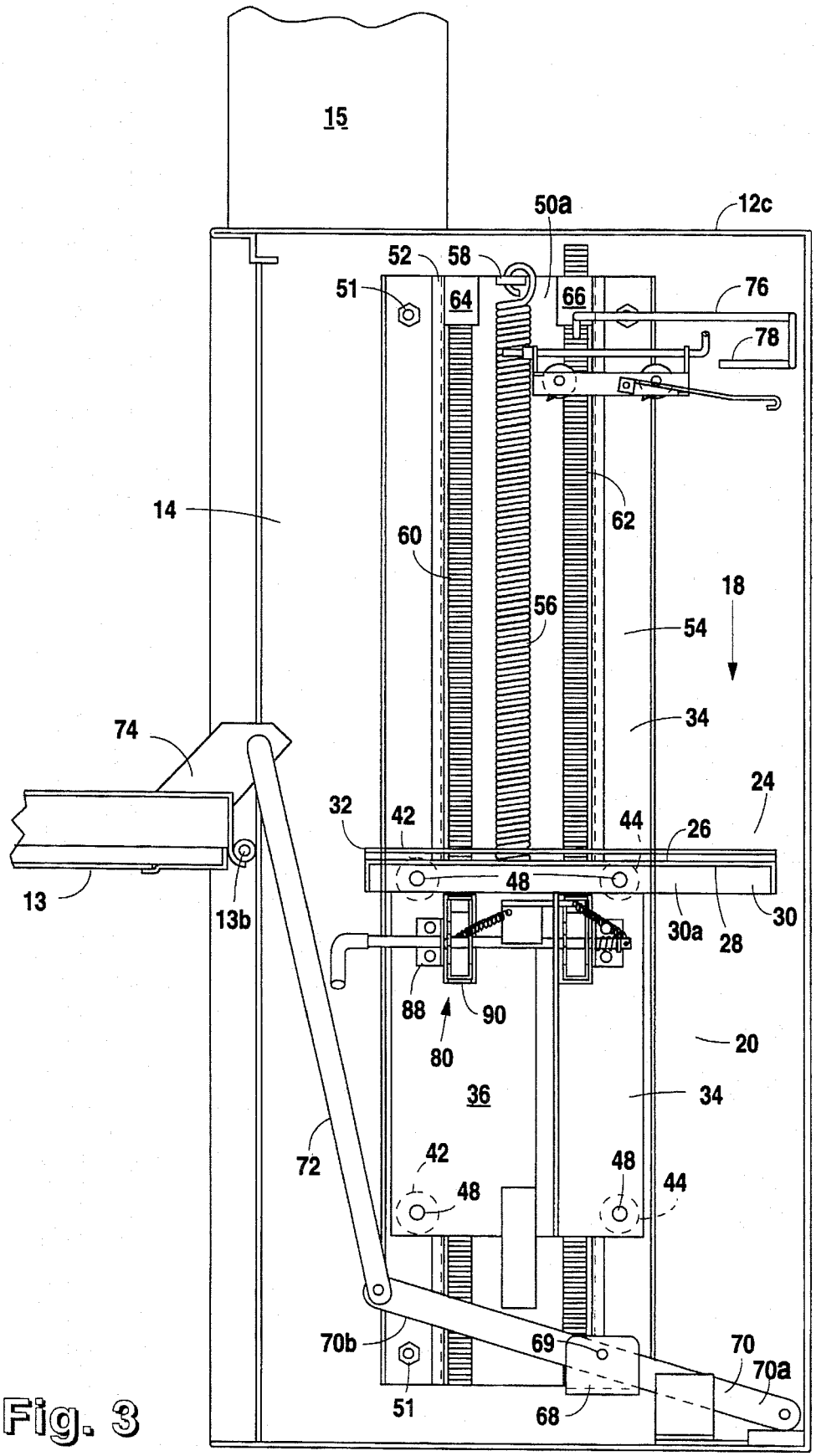
FIG. 3 is a side elevational cut-away view of applicants' invention showing the door in an open position with the foot engaging the lower end of the moveable threaded rod and illustrating features of the paper feed mechanism of applicants' present invention.

FIGS. 1–3 illustrate details of applicants' invention. Applicants' invention is embodied within a cabinet (10) of a newspaper vending machine, the cabinet having four tabular steel side walls (12*a*), including a front wall (12*b*) and a top wall (12*c*). This provides a rectangular enclosure for the newspapers and such cabinets are well known in the art, the specific embodiment of applicants' invention being shown here is for inclusion within a cabinet manufactured by assignee Kaspar Wire Works known as Model SV-101. Hinged for pivoting at hinge (13*b*) on front wall (12*b*) is a door (13) having a handle (13*a*). The door is typical of those well known in the trade and is provided with a hook mechanism to lockingly engage a coin mechanism (15) for releasing the door.

The details of the hook and lock mechanism are not germane to applicants' present invention. When the door unhooks, the handle is swung downward along door hinge (13*b*) through an arc of about 90° to provide access to the newspaper by the consumer.

Front wall (12*b*) defines a front wall opening (14) into which the door (13) comfortably fits. Thus far, applicants have described cabinets, doors, handles and mechanisms, all well known in the art.

Fittable within the perimeter of front wall (12*b*) and sealing off front wall opening (14) is an insert (16) engageable along hinge (13*b*) of door (13), whose details will be related further in paragraphs set forth below.

Confined within the interior of side walls (12*a*) is an elevator shelf mechanism (18) which includes a tabular platform upon which the newspapers to be vended lay in a stack, one on top of the other. (See FIG. 2.) Typically, the newspapers are folded with the crease forward or facing the door.

Applicants' elevator shelf mechanism (18) is comprised of a number of subcomponent mechanisms, including a paper elevation control mechanism (20) illustrated here in more detail in FIGS. 1, 2 and 3. The paper elevation control mechanism is designed to ensure that the stack of papers is continually urged upward and is properly positioned for effective engagement with a paper feed mechanism and dispensing to the consumer. While the paper elevation control mechanism ensures the proper position of the paper as it is urged upward, a paper feed mechanism (22) illustrated in FIGS. 1, 4 and 5 assures that the properly positioned paper is properly fed through insert (16) in ways set forth in more detail below, in a one by one (single vend) fashion.

Turning now to the details of the paper elevation control mechanism (20), it is seen that a tabular shelf (24) is provided to support the stacked papers, the shelf having an upper surface (26) and a lower surface (28). Further, the shelf, of necessity having to be sturdy enough to support a full stack of papers, is seen here to have four side walls depending from upper surface (26) vertically downward, including side wall (30*a*), front wall (30*b*) and rear wall (30*c*). Side wall (30*a*) has structure functions set forth in more detail below.

Visible in FIGS. 1, 2 and 3 and located on upper surface (26) of shelf (24) is a ridge (32) which is located centrally on the top surface and functions to prevent the papers from slumping in the middle. The ridge has a pair of parallel trending openings (32*a*) that are designed to lay beneath the two pairs of wheels (172) as seen in FIG. 1, the wheels mounted to carriage (134).

The paper elevation control mechanism (20) includes a guide mechanism (34) for ensuring the proper vertical movement of shelf (24) between a lower position in which the vendor stacks the papers and an upper limit representing the last paper vended. The movement of elevator shelf (24) must, of course, be a smooth controlled vertical movement and must not bind or jam if the device is to work properly. The function of applicants' guide mechanism (34) is to ensure such proper movement and to provide other features as set forth in more detail below. Guide mechanism (34) includes mounting plate (36) which, along with a diagonal member (38) provides the vertical support for shelf (24). It is to be appreciated here that shelf (24) is supported solely from one side of walls (12), here side wall (12*a*). Thus, diagonal member (38) transmits a torque or twisting force to mounting plate (36). Mounting plate (36) is rigidly mounted to diagonal member (38) which is also rigidly mounted to lower surface (28) of shelf (24). That is, shelf (24) is not supported directly from the floor of the cabinet nor is it supported equally from both side walls. Clearly, mounting plate (36) and diagonal member (38) must be sturdy enough to withstand buckling or undue flexing when fully loaded with newspapers.

Further, mounting plate (36) has channel sections (40*a*) and (40*b*) on either end thereof. The channel sections provide an appropriate structure to mount a pair of grooved roller sets, specifically grooved roller set (42) which has an upper roller and a lower roller and a grooved roller set (44) which has an upper roller and a lower roller. These rollers are mounted in the fashion set forth in FIGS. 1, 2 and 3 on axles (48), the axles being typical nut and bolt fasteners which extend through the channel portion (40*a*) and (40*b*) as well as through holes in side wall (30*a*) of shelf (34).

It is seen with reference to the figures how the four rollers having grooves (43) thereon engage a guide member (50) having lips (52). Guide member (50) has the profile of a "U" with lips (52) extending off the upright arms of the "U". The lips (52) are aligned parallel and trend vertically at opposite ends of guide member (50) whose body portion (50*a*) attaches to side wall (12*a*) in a manner more fully set forth below. Guide member (50) is made of a strong, durable metal and is designed in conjunction with mounting plate (36) such that the roller's groove (43) engages lip (52) to provide a rigid mounting of shelf (24) to side wall (121) yet allowing shelf (24) to move up and down vertically in an efficient manner without buckling. Thus, shelf (24) rides on rollers (42) and (44) up and down vertically, down when the vendor loads new papers and up as each paper is vended in the manner set forth in more detail below.

In the preferred embodiment of applicants' present invention, guide member (50) is rigidly mounted to the side wall (12*a*) through wall engaging bracket (54) which has a plain "U" shape but with a width substantially larger than the "U" of guide member (50). Wall engaging bracket (54) mounts to paper control elevation member (20) to side wall (12*a*) with fasteners known in the trade, here threaded studs and a nut (51) (See FIG. 2).

Shelf (24) is urged upward through the action of coil spring (56) which is attached to side wall (12*a*) through upper spring mounting plate (58) and is also mounted, typically, to mounting plate (36) at a second end to continually urge shelf (24) upward.

Applicants' elevator shaft mechanism (18), however, provides additional features beyond simply guiding and urging shelf (24) upward. More specifically, applicants provide two rigid threaded rods within the "U" body (50*a*) defined by guide member (50). These rods comprise a fixed threaded rod (60) and a moveable threaded rod (62). The fixed threaded rod (60) is located by the use of mounting box (64) comprised of walls welded to guide member (50) in the manner set forth in FIGS. 1, 2 and 3, to provide a boxed enclosure for one end of fixed threaded rod (60). The lower end of fixed threaded rod (60) is likewise boxed in at the lower end of guide member (50). Both threaded boxes have end walls (64*a*) preventing the vertical movement of rod (60). Note that both threaded rods are aligned vertically with the grooved roller sets.

Moveable threaded rod (62), however, is mounted through the use of guide boxes (66) on the upper and lower ends of guide member (50) and opposite mounting boxes (64). However, guide boxes (66) do not have the end walls (64*a*) to box in the rod and instead are open and allow the rod to pass freely along a vertically axis, up and down, in a manner more fully set forth below.

Turning now to moveable threaded rod (62), it is seen that its vertical movement downward under its weight is arrested by a foot (68) that is pivotally engaged to lever (70) which, in turn, is rigidly mounted at a first end (70*a*) to the floor such that it can pivot at end (70*a*) to lift foot (68), pivotally mounted on pin (69) up and down as door (13) is opened. More specifically, lever (70) is moved up and down at end (70*b*) through the action of lever (72) which is in turn pivotally mounted to bracket (74) to the lower edge of the door near hinge (13*b*).

Bracket (74) is mounted to the door such that when the door moves between an open position and a closed position (about 90° of travel) bracket (74) moves lever (72) which in turn moves end (70*b*) of lever (70) such that the foot engages the lower end of moveable threaded rod (62) to raise it up. When the door is closed, foot (68) drops and moveable threaded rod (62) drops.

Near the upper end of moveable threaded rod (62) is rigidly mounted arm (76). Arm (76) has prong (78) extending from the removed end thereof. As is visible in FIG. 1, prong (78) extends over the top of shelf (24) to provide an upper limit for the stack of new newspapers being inserted between the upper surface of the shelf and prong (78). That is, prong (78) provides for the vendor the upper limit for the stack of papers to be vended. At the same time, when the door is closed, arm (76) will drop and prong (78) will rest near the rear edge of the topmost paper in the stack. The purpose of prong (78), in cooperation with a rachet/release lock mechanism comprising two dogs and the two threaded rods, and lever operated foot (68) is to maintain the topmost paper adjacent slot (202) (FIG. 2) as papers—thick or thin, are dispensed. More details on this to follow.

It is to be appreciated that the vendor, when loading a new stack of papers into the cabinet, would like to be able to temporarily locate shelf (24) in a lower position without having to hold it down with his hands as he loads the machine. Furthermore, it could be appreciated that the vendor would like to have the door, normally biased by springs in the hinge to a closed position, to be propped open allowing him to use two hands to load the papers. Applicants' invention allows for both such convenient features.

A ratchet/release lock mechanism (80) (FIGS. 1, 2, 3, 6, and 7) mounted on mounting plate (36) is comprised of a handle (82) having removed end (84) and near end (86) and functions to lock the shelf in a lower position. Handle (82) is mounted to mounting plate (36) through a pair of brackets (88). Windows (90) are provided as cut outs in mounting plate (36) to expose fixed threaded rod (60) and moveable threaded rod (62) to dogs (92) and (94). It can be seen with reference to FIGS. 2, 3, 6 and 7 that handle (82) has mounted thereto and free to rotate about, dogs (92) and (94). Dogs (92) and (94) are channel-shaped in cross section and have edges (96*a*) and (96*b*) that can engage the threads of rods (60) and (62) depending on the position of the dogs, which position is determined by the position of handle (82). Rigidly mounted to handle (82) and free to articulate with handle (82) as it rotates on brackets (88) is spring mounting plate (98) having legs (98*a*), (98*b*) and (98*c*) extending therefrom.

Figure 6:
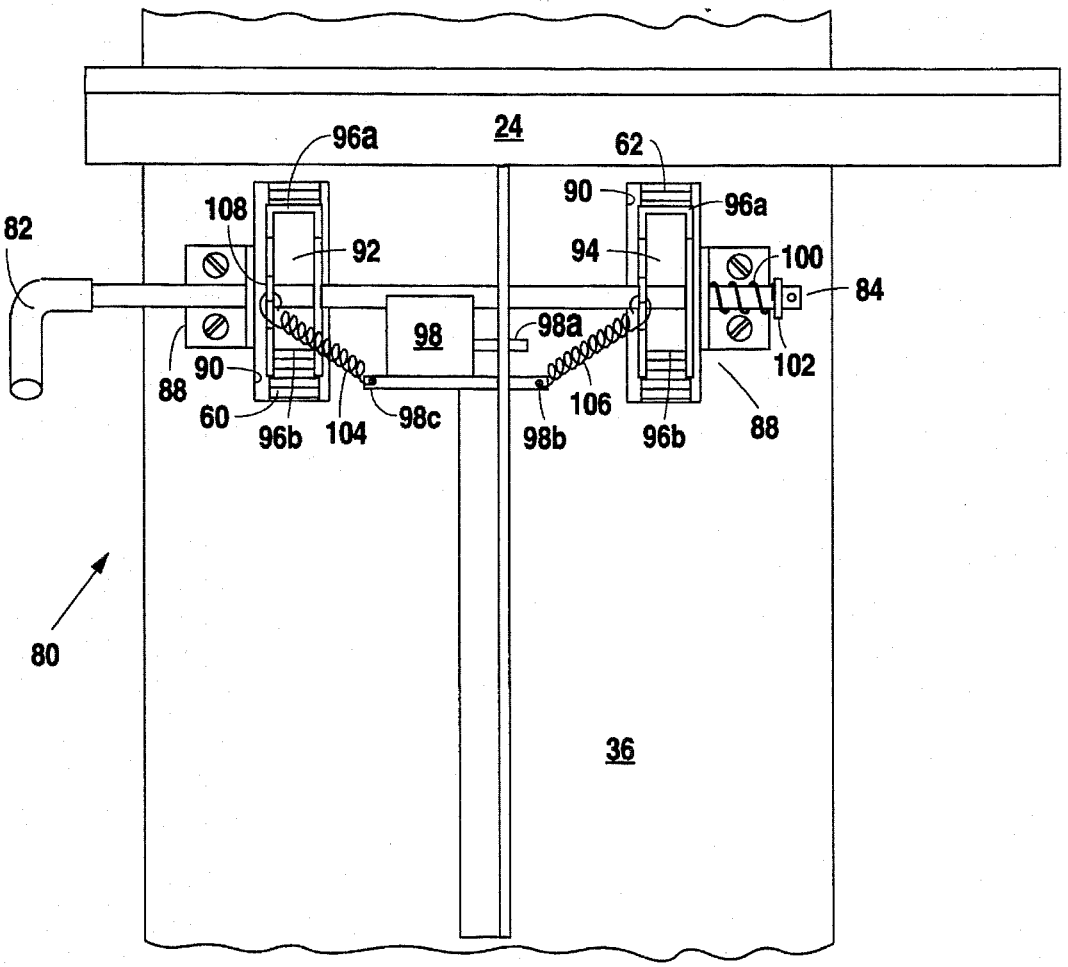
FIG. 6 is a side elevational view of details of the ratchet mechanism of applicants' present invention removed from the remainder of the apparatus.
Figure 7:
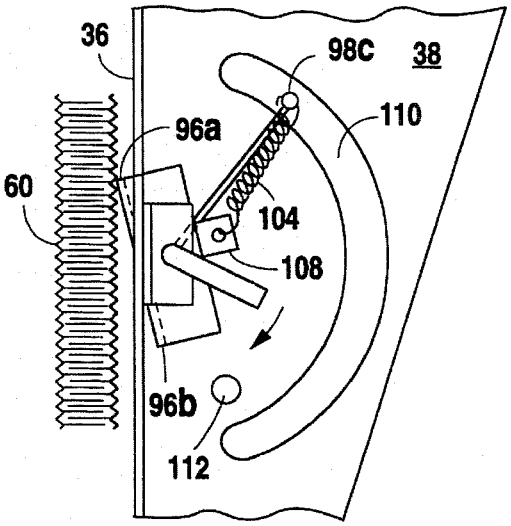
FIG. 7 is a front elevational view of details of the handle and ratchet mechanism of applicants' present invention as removed therefrom.

Handle (82) is normally biased toward the right as seen in FIG. 6 by action of spring (100) against mounting pin (102) as spring acts against the rear surface of the right-most bracket (88) as seen in FIG. 6.

Turning now back to plate (98), it is seen that arms (98*b*) and (98*c*) have extending from the ends thereof, springs (104) and (106). The springs are attached to tabs (108) which are part of the dogs. Thus, when the handle is up (FIGS. 3 and 7), edges (96*a*) of the dogs are urged against rods (60) and (62) and the shelf is prevented from moving upward under the urging of spring (56). The handle would be in this position when the vendor begins the loading procedure by opening the door, removing insert (16) and, with the handle in the position indicated in FIGS. 3 and 7, forcing the top of shelf (24) down. As the shelf rides downward, edges (96*a*) will bounce along the threads of rods (60) and (62). As soon as the vendor releases downward pressure spring (56) will urge shelf (24) upward and edges (96*a*) will immediately catch against rods (60) and (62) thereby maintaining the shelf at the lowest position urged and allowing the vendor to have two hands free while loading a new stack of papers to the top surface of shelf (24). When this task is accomplished, he may rotate handle (82) in a clockwise position from the position seen in FIG. 7, such that arm (98*b*) rides through slot (110) in diagonal member (38). Rotation of the handle should continue (see arrow, FIG. 7) until arm (98*a*) is adjacent plate locking hole (112) in diagonal member (38) where the removed end of arm (98*a*) engages hole (112) to lock the handle in a down position. This forces edges (96*b*) against rods (60) and (62) to allow the shelf to move only upward and preventing the downward movement of the shelf as it rides upward under the urging of spring (56) with the topmost paper of the stack resting against prong (78).

Figure 8:
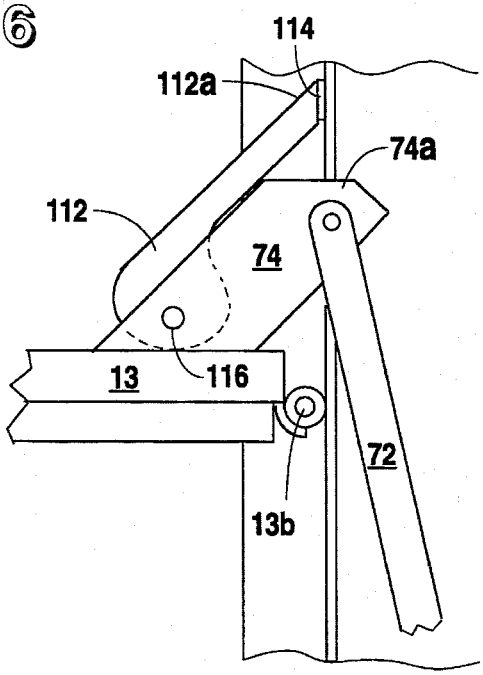
FIG. 8 is a side elevational view of a lever mechanism of applicants' present invention designed to prop the door open.

FIG. 8 illustrates the manner in which door (13) is locked in a down position while the vendor loads the papers. In FIG. 8, it is seen that laying adjacent bracket (74), rotatably attached thereto and flush against the bracket is lever (112) having removed end (112*a*) which is designed to engage boss or standoff (114) located adjacent front wall (12*b*) and just above the point where removed end (74*a*) of bracket (74) rests when the door is in the down or open position. It is seen that lever (112) is pivoted on pin (116) such that removed and (112*a*) is adjacent boss (114). When this is done and the door is allowed to close slightly under the urging of the door springs, towards its normally closed position until removed end (112*a*) rests against boss (114) to hold the door in a down position, almost perpendicular to its normally closed position. This will free the hands of the vendor and allow him to place the papers onto the shelf. It is understood, of course, that inset (16) is removed during the loading process. When the vendor is done loading new papers, he can pull the door down slightly and simply push removed end (112) downward to allow lever (112) to rotate downward so that the door can clear boss (114) and close.

Thus, it is seen how applicants' controlled elevated shelf may be locked in a down position for ease of loading, while the door is also locked in a down position. These two features allow the vendor, loading the machine, to have two hands free for stacking the newspapers properly on the top of shelf (24).

Figure 4:
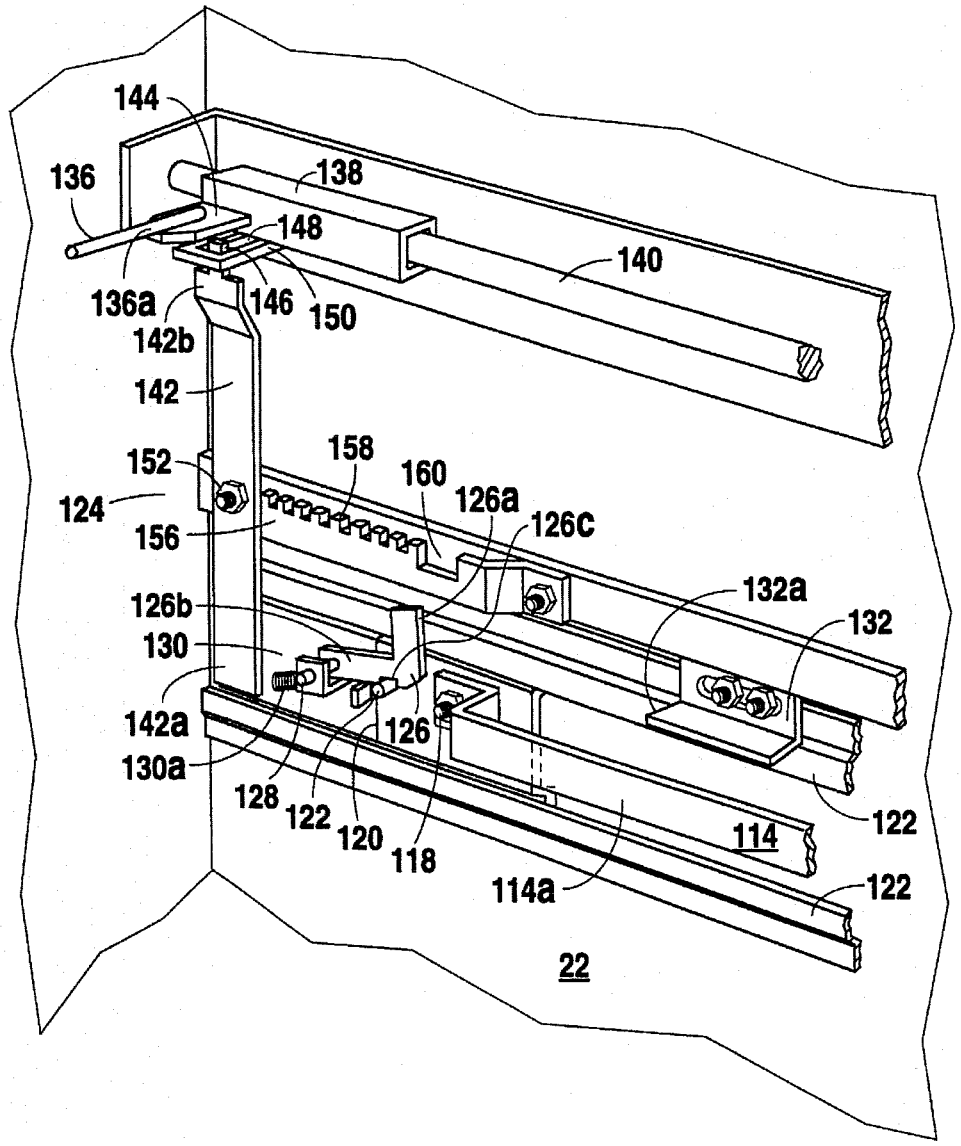
FIGS. 4 and 4A are perspective views of part of the paper feed mechanism of applicants' present invention.
Figure 5A:
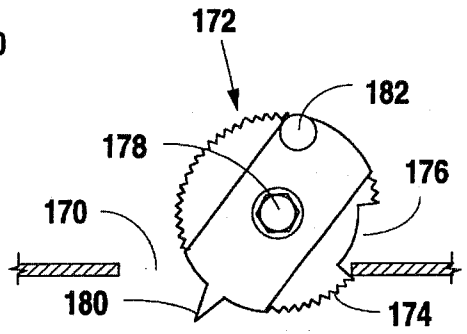
FIGS. 5A and 5B are side elevational views of the wheels of the carriage of applicants' present invention removed from the carriage illustrating the wheels in an extended (FIG. 5A) and a retracted (FIG. 5B) position.
Figure 5B:
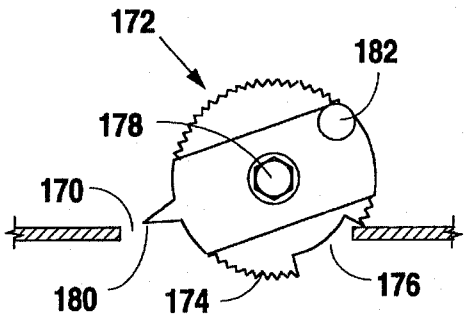
Figure 5:
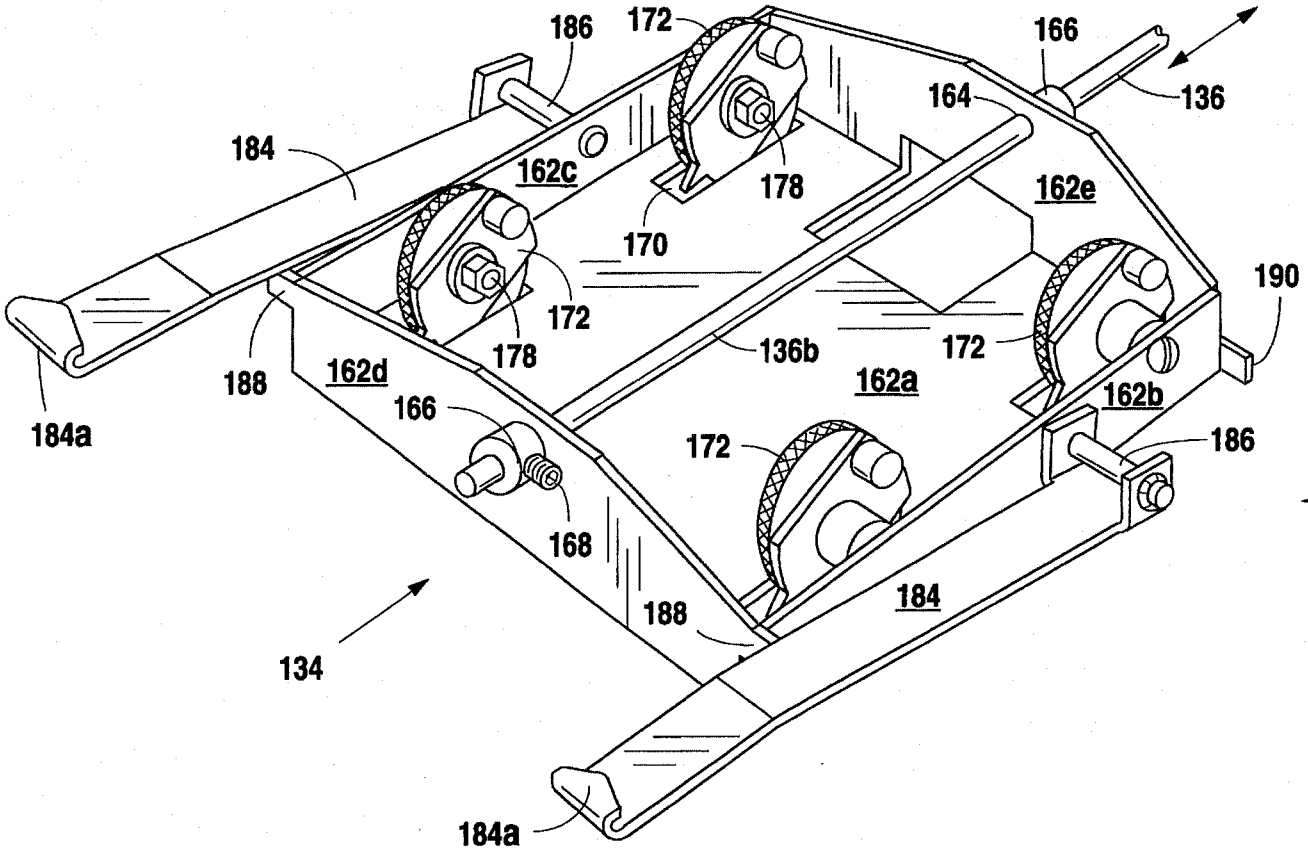
FIG. 5 is a perspective view of the carriage portion of the paper feed mechanism of applicants' present invention removed from the rest of the apparatus.

Applicants direct the reader's attention now to the details of paper feed mechanism (22) as more fully set forth in FIGS. 1, 4 and 5. More specifically, FIG. 4 illustrates actuating rod (114) having a removed end rotatably mounted to a stub (not shown) attached to the inside of the door near the hinge such that, as the door is moved between an open and a closed position, actuating rod (114) moves between a retracted position (FIGS. 1 and 4) and extended position. Near end (114*a*) of actuating rod is rotatably mounted on a pin, such as a nut and bolt fastener (118), to actuating rod mounting plate (120). Mounting plate (120) is free to slide along channel guides (122) between a fore and aft position. Mounting plate (120) is seen to have engagement rod (122) mounted perpendicular to the surface thereof.

A sliding mechanism (124) is activated to move fore and aft as a unit along channel guides (122) when engaged with engagement rod (122) as the door opens and closes. Sliding mechanism (124) is made of a number of components. Latch (126) having arm (126*a*) and base (126*b*), the base having notch (126*c*) dimensioned to engage engagement rod (122), is free to articulate on pin (128) which mounts the latch to a sliding mechanism mounting plate (130). Plate (130), like actuating rod mounting plate (120), is free to slide in channels (122) in a fore and aft motion. Spring (130*a*) is attached at one end to the removed end of base (126*b*) aft of pin (128) and the second end to mounting plate (130), normally biasing latch (126) in a counter-clockwise rotation (that is, against engagement rod (122)) as seen in FIG. 4. Thus, a normally engaged position exists between sliding mechanism (124) and mounting plate (120) such that as actuating rod (114) moves to the right as the door is opened (as illustrated in FIG. 4), mounting plates (120) and (130) move as a unit. However, boss (132) is mounted adjacent the upper of channels (122) as indicated in FIG. 4, such that arm (126*a*) of latch (126) will strike leading edge (132*a*) of boss (132) as the door is opened approximately 30°–45°. Continued movement of the door towards the open position after arm (126*a*) strikes leading edge (132*a*) causes latch (126) to pivot upward (counterclockwise as seen in FIG. 4) and disengages rod (122) from notch (126*c*) and represents a forwardmost movement of sliding mechanism (124). This disengagement of the sliding mechanism has proven to be helpful in preventing jammed mechanisms.

It is seen in FIG. 1 how if sliding mechanism (124) moves as the door is opened, it will move carriage (134), which is normally resting against the topmost paper of the stack, forward or towards an extended position. Carriage (134) is seen to be mounted on carriage arm (136). Turning back to FIG. 4, the remaining details of sliding mechanism (124) may be appreciated.

Mounting plate (130) is engaged with carriage arm (136) through interconnect bar (142). As can be seen in FIG. 4, interconnect bar (142) carries slider (138) along a side wall-mounted guide bar (140) between a fore and aft position. Located on tongue (144) for mounting to the walls of slider (138) near end (136*a*) of carriage arm (136). That is, interconnect bar (142) is rigidly mounted at a first-end (142*a*) to mounting plate (130). At a second-end (142*b*), the interconnect bar has tongue (146) which engages groove (148), the groove being defined by walls of extension member (150) connected to the slider (138). The use of slider (138) that pivots about guide bar (140) combined with the use of tongue (146) and groove (148) allows carriage (134) to raise up and down somewhat on removed end (136*b*) of carriage arm (136) without binding.

Figure 4A:
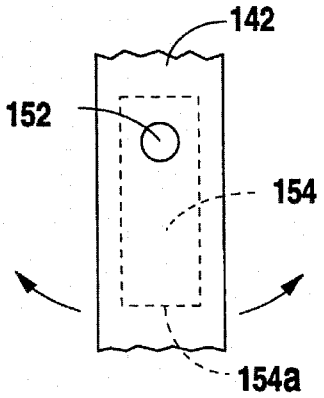

Turning now to FIG. 4A, it can be seen that interconnect bar (142) has connected to the inner surface thereof, rotatably mounted on pin (152) a catch bar (154) which can swing freely in either direction as indicated by the arrows in FIG. 4A. Turning back to FIG. 4, it is seen that located above channels (122) is a rack (156) having square profile tooth portion (158) mounted thereon. Moreover, on either end of toothed portion (158) are gaps (160) (the gap on the left end of rack (15*b*) not shown). The toothed portion and the gaps engage catch member (154) at lower end (154*a*) thereof as interconnect bar moves between a fore and aft position. When interconnect bar is in the rearward or aftmost position (as seen in FIG. 4) it will engage a gap (not shown) in the rearward portion of rack (156) such that catch member (154) is hanging vertically downward. As the door is open with mounting members (120) and (130) engaged through latch (126), catch member (154) rides over toothed portion (158) of rack (156). This occurs while the door is moving between about zero to 30°–45° in its arc as it swings between a closed and open position. In between the closed position and this intermediate position, located about 30°–45°, the intermediate position being the point at which the leading edge of latch (126) meets leading edge (132*a*) of boss (132), the engagement of removed end (154*a*) of catch member (154) allows the door to open but does not allow the user to begin to shut the door. If the user were to begin to shut the door at, say 20°, removed end (154*a*) would interfere with teeth (158) to prevent such movement. When the door meets the intermediate position such that latch (126) engages leading edge (132*a*), then catch member (154) falls into gap (160). Anytime thereafter, if the door is reversed, removed end (154*a*) of catch member (154) would again engage teeth as interconnect bar (152) moved towards the aft or retracted position, but this time the teeth would prevent the user from re-opening the door, at least between the last 30°–45° of closing.

Further details of paper feed mechanism (22) may be appreciated with reference with reference to FIG. 5. More specifically, carriage (134) is seen to comprise a generally rectangular frame (162) having a floor (162*a*) and upright side walls (162*b*) and (162*c*) as well as a front wall (162*d*) and a rear wall (162*e*). Mounting holes (164) in the front and rear walls allow end (136*b*) of carriage arm to mount to frame (162). Moreover, frame (162) can be adjusted to be selectively located on removed end (136*b*) by the use of collars (166) adjacent to front and rear walls of the frame, which collars have set screws (168) in the walls thereof.

Reference to FIG. 5 illustrates that floor (162) contains four cutouts (170) near the four corners thereof. Protruding partially through these cutouts and pivotally mounted to the side walls are rotating wheels (172). Details of wheel (172) may be appreciated with reference to FIGS. 5A and 5B illustrating the two extreme positions of the wheel. Wheels (172) have rims (174) on the outer perimeter thereof, at least a portion of which is toothed as illustrated in FIGS. 5A and 5B. The toothed portion of rim (174) is designed to extend below the floor of frame (162), that is, through cutouts (170). The rim is also seen to have in the perimeter thereof notch (176) which engages the walls of cutout (170) to allow the wheel to move in about a 15 to 40 degree arc between a position with needle (180) extended (FIG. 5A) and retracted (FIG. 5B). Wheels (172) are free to articulate or rotate through the range determined by the length of notch (176) on axle (178) which is mounted to side walls (162*c*). As carriage (134) moves from a retracted to an extended position wheels (172) move from the position illustrated in FIG. 5B to the needle-down position illustrated in FIG. 5A. Needle (180) engages the top of the topmost paper to ensure that as the carriage is moving forward on carriage arm (136), the top of the paper is pushed through insert (16). When the carriage has reached its forwardmost or extended position, it will then begin its retraction in which wheel (174) will pivot to the position illustrated in FIG. 5B then slide across the top of the next paper as the carriage retracts. Note that counterweight (182) helps bias wheel (172) to a needle-retracted position such that when new papers are inserted and the door is closed or the carriage is lifted off the papers, the needle is in the retracted position as illustrated in FIG. 5B.

FIG. 5 also illustrates pivot fingers (184) pivotally mounted adjacent the outside surface of side walls (162*b*) and (162*c*) on studs (186). Fingers are seen to have at the removed ends a lip portion (184*a*) and to be rotatable to a forward position as illustrated in FIG. 5A where the fingers rest against forward bosses (188). The fingers may be flipped approximately 180° from the position illustrated in FIG. 5 so they rest against rearward bosses (190).

Applicants' single vend machine is designed to effectively vend thin newspapers (up to about 8/1 inch thick in a folded condition) or magazines between about ¼ inch to 3/16 inch thick (usually with the use of liners on the inside of the cabinet walls, sized to the magazine's length and width). To help properly vend thicker papers (between about ⅛ inch and about 5/16 inch thick in a folded condition), fingers are flipped rearward from the position illustrated in FIG. 5 until they rest against rearward bosses (190). In this position when the carriage is in a fully retracted position and begins to move forward, lips (184*a*) can pick up the top few pages of the topmost paper and help assist the carriage carrying the vended paper as it slides over the paper just below it.

Last, details of insert (16) are now set forth. More specifically, with reference to FIGS. 1 and 2, insert (16) is seen to have rectangular shaped front wall (192) substantially sealing front wall opening (14). Insert wall (192) has an upper perimeter engagement lip (194) which is typically L-shaped and engages front wall (12*b*), more specifically, the top edge of front wall (12*b*). Along the lower edge of insert wall (192) is hinge engaging member (196) curved to wrap at least partially around hinge (13*b*). Thus, insert (16) can be placed within front wall opening (14) by placing hinge engagement lip (196) adjacent hinge (13*b*) and rotating the insert until engagement lip (194) engages the upper edge of front wall (12*b*). Key insertable lock (198) can then be rotated such that blade (200) locks insert to front wall (12*b*) between blade (200) and engagement lip (194) as seen in FIG. 2.

Insert wall (192) is seen to have walls defining slot (202) which is elongated and exceeds the width of the paper, is dimensioned to receive the paper there through. Typically, slot (202) is between about ⅛ inch and about ⅝ inch in width. Rearward of slot (202) is flap or cover (204) which pivots along hinge (206) in one direction—to allow the paper to slide out (clockwise as seen in FIG. 2). Upper wall (210) is used to support hinge (206) as illustrated in FIG. 1 and 2. Lower wall (208) is seen to prevent the counterclockwise or inward movement of cover (204) from the position illustrated in FIG. 2. It is seen how a combination of a flap or cover (204) to slot (202), both the flap and cover dimensioned to allow the receipt of a paper therethrough, would allow the topmost paper of a stack, being urged under the impetus of a carriage which extends as the door is opened, moving the paper through cover (204) and slot (202) a few inches to allow the consumer's hand to reach the leading edge of the paper and to extract it from the slot.

It is to be appreciated that the topmost paper must always be above lip (212) of lower member (208) yet cannot be above hinge (206). If the topmost paper were out of the proper vertical position, there would be interference between the insert and the paper. The paper would not be properly aligned with cover (204) and slot (202) to ensure proper dispensing of the paper.

Figure 8A:
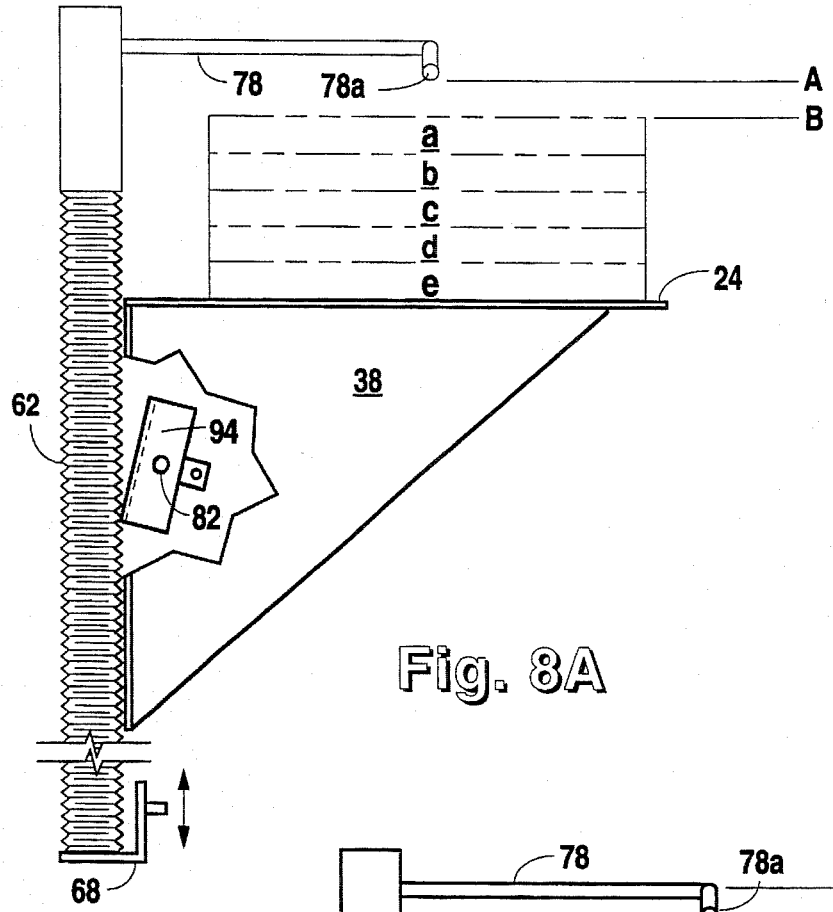
FIGS. 8A and 8B illustrate front elevational views of details of applicants' present invention, specifically the automatic thickness adjustment device of applicants' present invention.
Figure 8B:
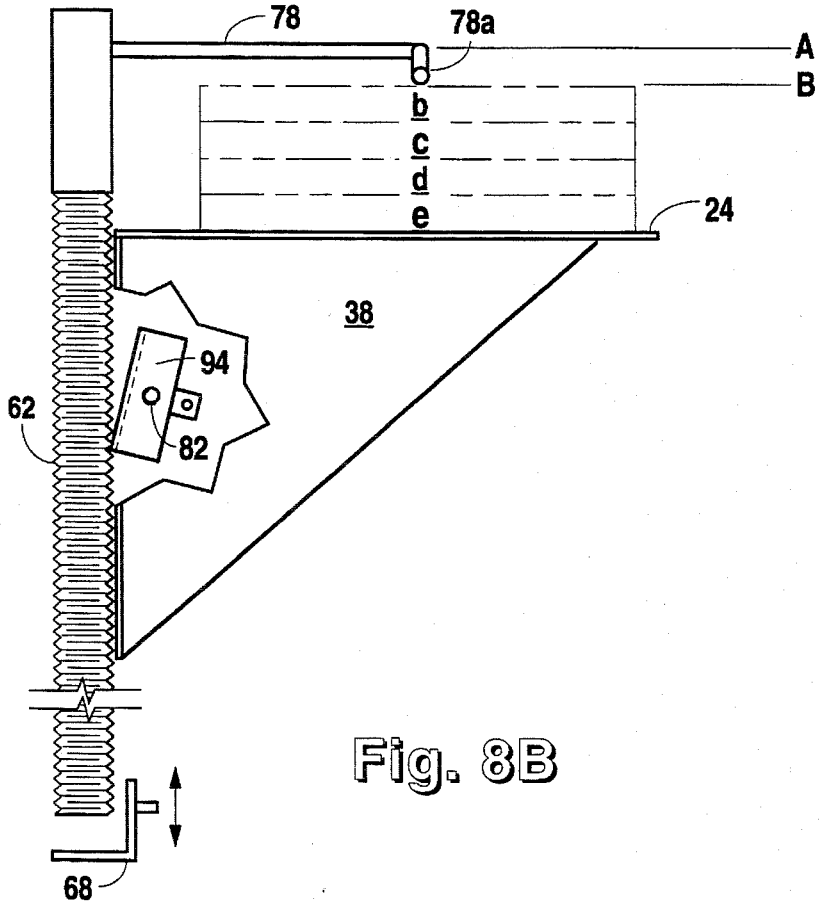

FIGS. 8*a* and 8*b* disclose additional features and the manner in which applicants' automatic thickness and shelf elevation adjustment mechanism works. Following a vend of a newspaper, the shelf stays at the same level, held in place by dogs (92) and (94), which act as a rachet mechanism as they engage the two rods (60) and (62). However, when the door is opened, the foot (68) will raise, through the actions of the levers as set forth above, and the movable rod (62) will be raised. The foot (68) will raise the shelf as the door opens, as the dogs (60) and (62) act as ratchets against rods (60) and (62). When the door is fully opened, the shelf will be adjusted to a height adjacent slot (202). When the paper is vended and the door is still open, there will be a gap which represents the distance between A and B as illustrated in FIG. 8*a*. That gap represents the thickness of the newspaper vended; however, when the door closes and the foot falls, so will rod (62) until prong (136*a*) engages the next paper, here paper B. Whether paper A (the first vended paper in FIG. 8A) is thick or thin makes no difference, as the foot will raise the shelf a sufficient number of notches to account for the thickness of the paper and bring the top-most paper to the proper position with respect to the slot. If the paper is thin, it simply means that the foot will raise further before it engages movable rod (62), and then the shelf will move the rod up only a few clicks or notches on the rod. Where, if the vended paper is thicker, the foot will engage the removed end of the movable rod (62) sooner, as the door is being opened, and lift the rod (62) more clicks or notches, raising the shelf further. Here, by the combination of a fixed and a movable rod combined with the ratchet mechanism made up of two spring biased dogs, the shelf elevation will automatically adjust for either a thick or a thin paper, and will automatically bring the top-most paper adjacent the slot.

Terms such as "left," "right," "up," "down," "bottom," "top," "front," "back," "in," "out," and like are applicable to the embodiments shown and described in conjunction with the drawings. These terms are merely for purposes of description and do not necessarily apply to the position or manner in which the invention may be constructed for use.

Although the invention has been described in connection with the preferred embodiment, it is not intended to limit the invention's particular form set forth, but on the contrary, it is intended to cover such alternatives, modifications, and equivalences that may be included in the spirit and scope of the invention as defined by the appended claims.

What is claimed is:

1. An apparatus for dispensing and vending newspapers, one at a time, from a stack of newspapers, the apparatus comprising:

a cabinet, said cabinet having walls defining a front opening;

a movable shelf for holding a plurality of stacked newspapers within said cabinet;

spring bias means to bias said shelf upward;

a hinged door pivotable between a closed position and an open position, said door mounted in the front opening of said cabinet;

an insert having a slot, the slot dimensioned for receipt of a paper therethrough, the insert dimensioned to fit within the front wall opening of said cabinet without interfering with the opening and closing of said hinged door;

feed means for engaging newspapers and feeding a single newspaper from a stack of multiple newspapers through the slot of said insert, from a stack position to a vend position;

lever means operatively engaging said door and said feed means wherein said door moving between a closed position and an open position moves said feed means to vend one of the stacked newspapers through the slot of said insert; and means to disengage said lever means from said feed means before said door reaches the open position.

2. The device of claim 1 further including means for preventing the reversing of the direction of movement of said door when said door is moving intermediate of the open and closed positions.

3. The device of claim 1, wherein said shelf is supported from only one of said walls of said cabinet.

4. The device of claim 1, wherein said feed means includes a carriage for engaging the topmost newspaper of the stack, the carriage being toothed wheels movable aft an extended and retracted position, the extended position for urging the topmost paper through the slot of said insert to the vend position and the retracted position for avoiding engagement with the topmost paper.

5. The device of claim 4, wherein the carriage of said feed means includes means to assist in the vending of papers thicker than a predetermined maximum.

6. The device of claim 1 further including means to disengage said lever means from said feed means before said door reaches the open position, and including means for preventing the reversing of the direction of movement of said door when said door is moving intermediate of the open and closed positions.

7. The device of claim 1 further including means to disengage said lever means from said feed means before said door reaches the open position, wherein said feed means includes a carriage for engaging the topmost newspaper of the stack, the carriage being toothed wheels movable aft an extended and retracted position, the extended position for urging the topmost paper through the slot of said insert to the vend position and the retracted position for avoiding engagement with the topmost paper.

8. The device of claim 1 further including means to disengage said lever means from said feed means before said door reaches the open position, and means for preventing the reversing of the direction of movement of said door when said door is moving intermediate of the open and closed positions, wherein said feed means includes a carriage for engaging the topmost newspaper of the stack, the carriage being toothed wheels movable aft an extended and retracted position, the extended position for urging the topmost paper through the slot of said insert to the vend position and the retracted position for avoiding engagement with the topmost paper.

9. The device of claim 8, wherein the carriage of said feed means includes means to assist in the vending of papers thicker than a predetermined maximum.

10. The device of claim 1 further comprising:

means for holding said normally upward bias movable shelf in a lowered position for ease in loading papers into said cabinet.

11. The device of claim 1, wherein said hinged door includes means for urging said hinged door toward the closed position and further including means for holding said hinged door in an open position against the urging of the spring of said hinged door.

12. The device of claim 8 further comprising:

means for holding said normally upward bias movable shelf in a lowered position for ease in loading papers into said cabinet.

13. The device of claim 8, wherein said hinged door includes means for urging said hinged door toward the closed position and further including means for holding said hinged door in an open position against the urging of the spring of said hinged door.

* * * * *